US006322386B1

(12) United States Patent
Tharp et al.

(10) Patent No.: US 6,322,386 B1
(45) Date of Patent: Nov. 27, 2001

(54) CONNECTOR BOOT WITH INTEGRAL LATCH RELEASE

(75) Inventors: Keith Franklin Tharp, San Jose; Timothy Mark Scarano, Hayward, both of CA (US)

(73) Assignee: The JPM Company, Lewisburg, PA (US)

( * ) Notice: Subject to any disclaimer, the term of this patent is extended or adjusted under 35 U.S.C. 154(b) by 0 days.

(21) Appl. No.: 09/659,642

(22) Filed: Sep. 12, 2000

(51) Int. Cl.[7] ..... H01R 13/629
(52) U.S. Cl. ..... 439/344; 439/447; 439/352
(58) Field of Search ..... 439/344, 606, 439/352, 447

(56) References Cited

U.S. PATENT DOCUMENTS

| | | | | |
|---|---|---|---|---|
| 4,995,826 | | 2/1991 | Schieferly | 439/347 |
| 5,207,593 | | 5/1993 | Bogiel | 439/352 |
| 5,255,154 | | 10/1993 | Hosoi et al. | 361/680 |
| 5,334,044 | * | 8/1994 | Falossi et al. | 439/447 |
| 5,399,109 | | 3/1995 | Sedig | 439/701 |
| 5,461,690 | | 10/1995 | Lampert | 385/100 |
| 5,462,457 | | 10/1995 | Schroepfer et al. | 439/736 |
| 5,613,869 | | 3/1997 | Erlich et al. | 439/344 |
| 5,620,335 | * | 4/1997 | Siemon | 439/447 |
| 5,640,476 | | 6/1997 | Womack et al. | 385/86 |
| 5,685,736 | * | 11/1997 | Lung | 439/344 |
| 5,725,324 | | 3/1998 | Pavelski | 403/321 |
| 5,785,540 | | 7/1998 | Jaklin | 439/157 |
| 5,941,726 | | 8/1999 | Koegel et al. | 439/358 |
| 5,947,776 | | 9/1999 | Epe | 439/752 |
| 6,071,141 | | 6/2000 | Semmeling et al. | 439/353 |
| 6,087,595 | | 7/2000 | Linhart | 174/136 |
| 6,089,898 | | 7/2000 | Lincoln, III et al. | 439/357 |

* cited by examiner

*Primary Examiner*—Gary Paumen
(74) *Attorney, Agent, or Firm*—Duane Morris & Heckscher LLP

(57) ABSTRACT

The invention provides a connector boot having an integral latch release for engaging an operative portion of a latching mechanism of a connector to switch the latching mechanism between a latched position and an unlatched position. In one embodiment, the boot includes a housing having exterior walls that define an internal cavity sized to accept a portion of the connector. The boot includes a latch release cowl that is integrally formed on one of the exterior walls of the housing. The release cowl comprises side walls and an outer wall that joins the side walls to form the cowl. Slots are formed in each of the side walls so as to form a cantilevered beam in a portion of the outer wall. Thus, when the connector is positioned within the internal cavity of the boot, the cantilevered beam of the release cowl is positioned in operative relation over the latching mechanism of the connector.

6 Claims, 3 Drawing Sheets

CONNECTOR BOOT WITH INTEGRAL LATCH RELEASE

Field of the Invention

The present invention generally relates to electrical connectors, and more particularly to devices adapted for the actuation of locking latches.

Background of the Invention

Electrical connectors typically have a multiplicity of terminal contacts positioned in an insulating housing, and arranged so as to be connected to a complementary connector to form a connector pair. It is well known to use mechanical latching mechanisms for maintaining the connection between the two connectors. The latching mechanism will ensure that the mating connectors maintain an electrical connection. Typically, the connector includes an integral latch member which is secured to the housing by a leg or biased hinge, or a connection point with the housing of the connector. The mating connector has a catch or a lug which will engage the latch mechanism when the two connectors are interengaged thereby ensuring that the connectors remain secured together. Examples of connectors utilizing such devices may be found in U.S. Pat. Nos.: 6,089,898; 6,071,141; 5,947,776; 5,941,726; 5,785,540; 5,725,324; 5,399,109; 5,255,154; 5,207,593; 4,995,826; 4,647,128; and 4,272,145.

These arrangements are not always satisfactory, especially when they are used in conjunction with multiple, but separate connectors that are positioned side-by-side. There is a need in the art for connectors that can be released from one another when latching mechanism is located in a remote position, or in an arrangement with other connector pairs that provides little or no space for actuation. This need in the art has become acute in connection with many "high density" interconnection systems, where unlatching must take place under difficult circumstances, e.g., in a blind space where several such connectors are arranged in a stacked configuration.

SUMMARY OF THE INVENTION

The present invention provides a connector boot having an integral latch release for engaging an operative portion of a latching mechanism of a connector to switch the latching mechanism between a latched position and an unlatched position. In one embodiment, the boot includes a housing having exterior walls that define an internal cavity sized to accept a portion of the connector. The boot includes a latch release cowl that is integrally formed on one of the exterior walls of the housing. The release cowl comprises side walls and an outer wall that joins the side walls to form the cowl. Slots are formed in each of the side walls so as to form a cantilevered beam in a portion of the outer wall. Thus, when the connector is positioned within the internal cavity of the boot, the cantilevered beam of the release cowl is positioned in operative relation over the latching mechanism of the connector.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
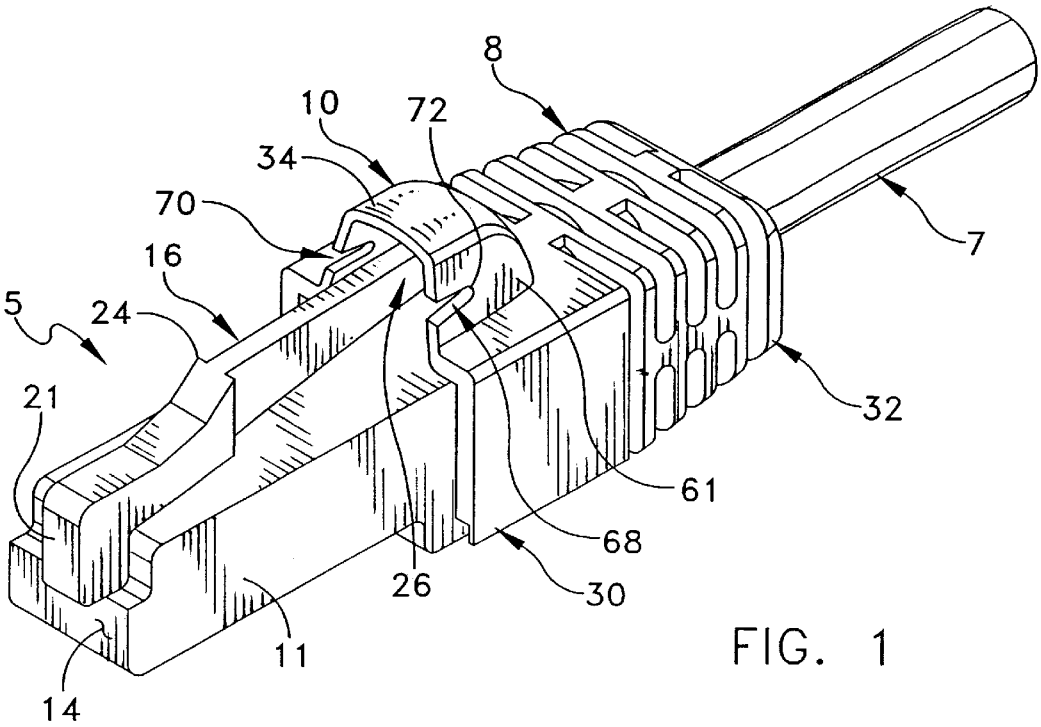
FIG. 1 is a perspective view of a connector boot having an integral latch release formed according to the invention, and assembled to an electrical connector including a terminated cable.
Figure 2:
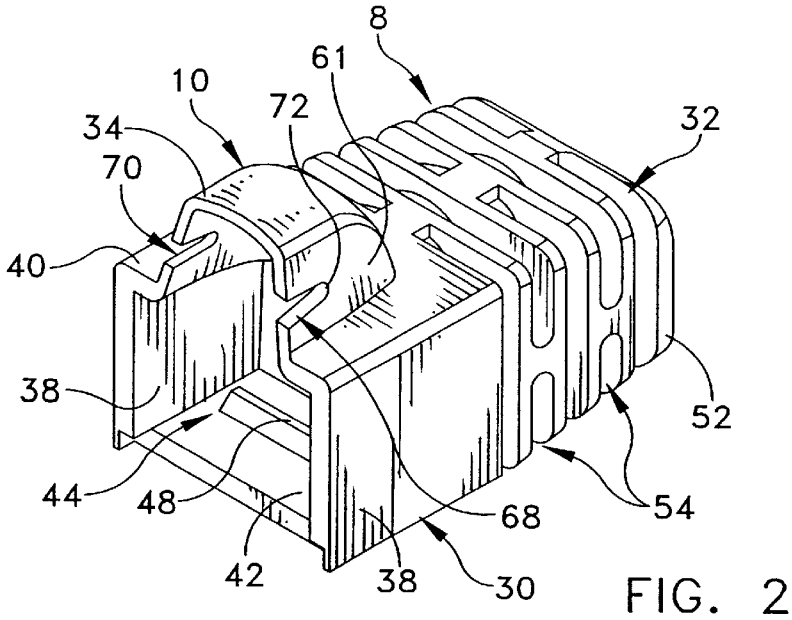
FIG. 2 is a perspective view of the connector boot having an integral latch release, as shown in FIG. 1 but with the electrical connector and cable removed for clarity of illustration.
Figure 3:
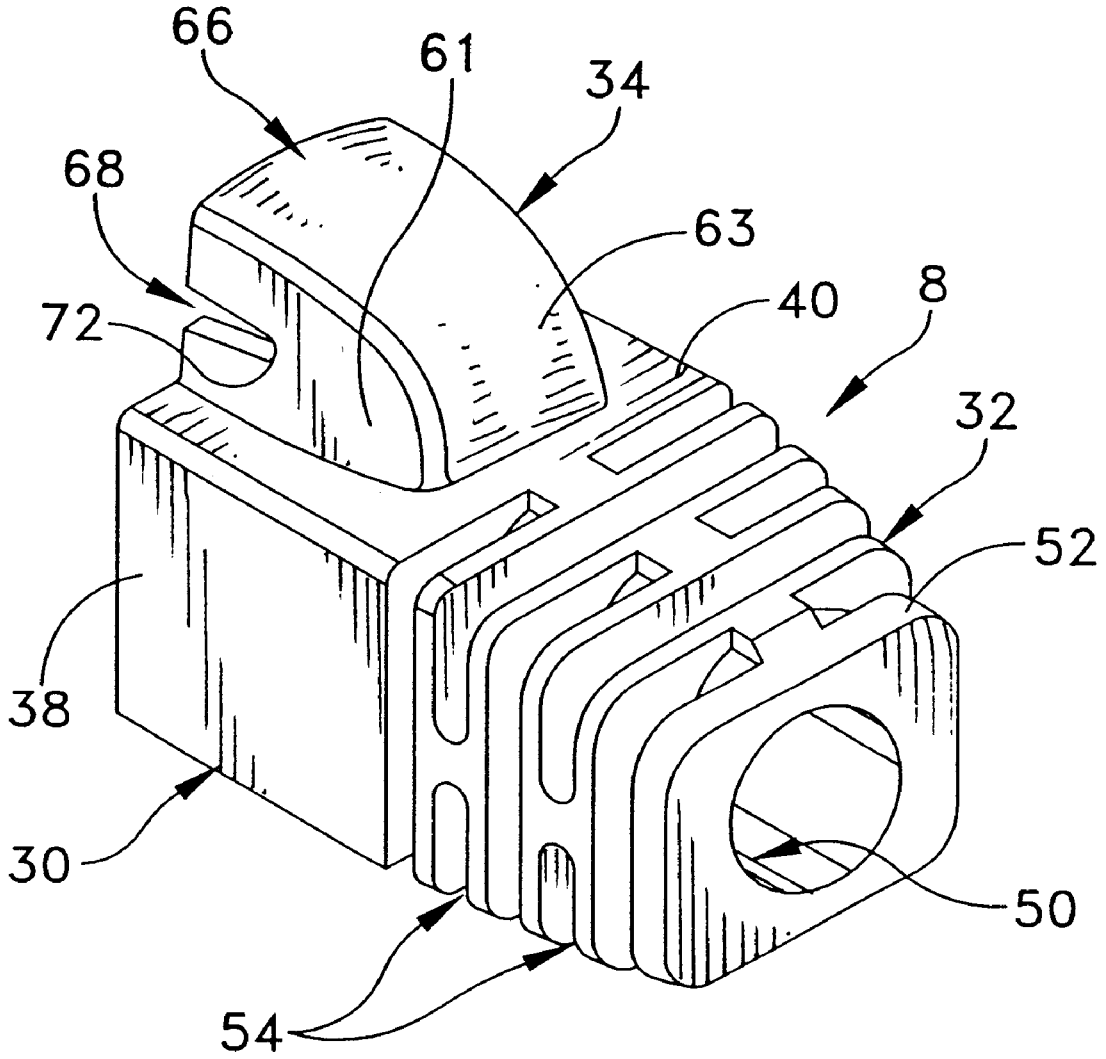
FIG. 3 is a rear perspective view of the connector boot having an integral latch release shown in FIG. 2.

This description of preferred embodiments is intended to be read in connection with the accompanying drawings, which are to be considered part of the entire written description of this invention. In the description, relative terms such as "horizontal," "vertical," "up," "down," "top" and "bottom" as well as derivatives thereof (e.g., "horizontally," "downwardly" "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

FIGS. 1–5 show an electrical connector 5 that is terminated to the end of a cable 7 and supporting a boot 8 having an integral latch release 10 formed in accordance with the present invention. More particularly, electrical connector 5 may comprise any of the well known high density interconnection devices that are known in the art. Connectors of this type typically include a plurality of closely spaced, electrically conductive pin or receptacle contacts (not shown) arranged within an insulative housing 11, and individually terminated at one end to a corresponding plurality of conductors (not shown) that form the central portion of cable 7. The electrical interconnection features of the plurality of closely spaced pin or receptacle contacts are positioned adjacent to an interface surface 14 of the connector.

Figure 4:
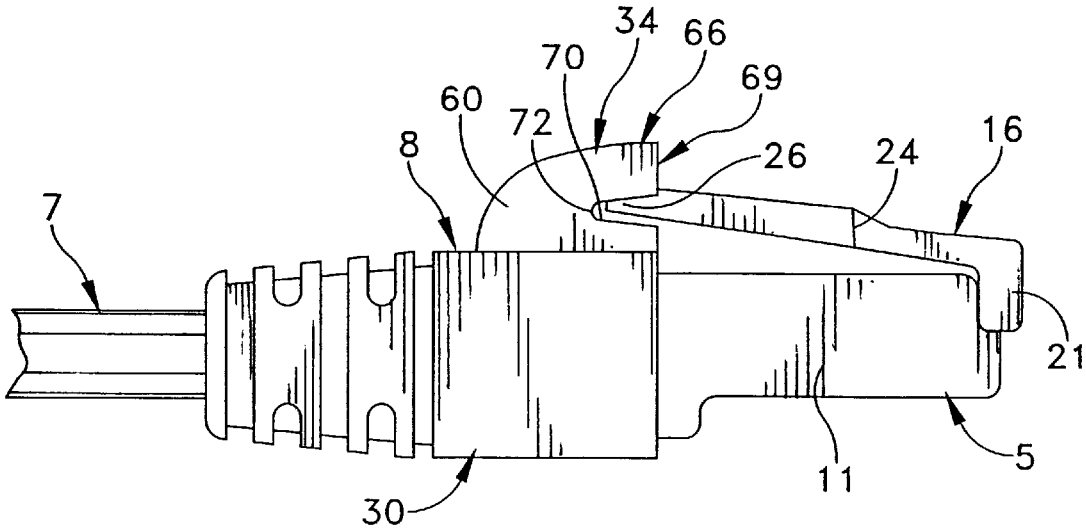
FIG. 4 is a side elevational view of the connector boot having an integral latch release formed according to the invention, and assembled to an electrical connector including a terminated cable as shown in FIG. 1.

Housing 11 of electrical connector 5 is typically formed from one of the well known polymer materials that are suitable for injection molding, e.g., polyhalo-olefins, polyamides, polyolefins, polystyrenes, polyvinyls, polyacrylates, polymethacrylates, polyesters, polydienes, polyoxides, polyamides, polycarbonates, polyterephthalates, and polysulfides and their blends, co-polymers and substituted derivatives thereof. Housing 11 also normally includes a resilient latch 16 having an operative portion positioned on an outer surface, and arranged to releasably engage a corresponding feature on a mating electrical connector (not shown) that may be, e.g., mounted on the edge of a printed wiring board or terminated to the end of another cable, or the like. Latch 16 may comprise various known shapes and include several alternative features that are adapted for releasably engaging a corresponding feature on the mating electrical connector, e.g., recesses, notches, shoulders, catches, or tabs, etc. FIGS. 1 and 4 show a representative latch 16 that includes a catch 24 that is adapted to engage a corresponding recess, or the like (not shown) on a mating connector.

Typically, latch 16 will comprise a cantilevered beam that is fixed, via a living hinge 21 or the like. For example, in the embodiments shown in FIGS. 1, 4 and 5, latch 16 extends rearwardly from interface surface 14 toward cable 7, and at an acute angle relative to the top surface of housing 11. In this way, depressing latch 16 toward the top surface of housing 11 stores elastic energy in living hinge 21 so that when released, latch 16 springs away from the top surface of housing 11 and toward its original unloaded position. Of course, the integral latch release of the present invention, and its obvious variations, is not limited in any way to the latch arrangement shown in the figures, but may be advantageously used in connection with many other arrangements of latches and connectors.

Terminal end 26 of latch 16 may include various known features that are adapted for aiding in depressing latch 16, and are arranged so that a finger 27 may depress terminal end 26 to release latch 16 from engagement with the mating connector. For example, when connectors are mated together latch 16 may be depressed, thus disengaging catch 24 from a corresponding recessed portion (not shown) on the mating connector. However, due to the high density requirements placed on such connectors, little or no space is available for the positioning of a person's finger directly over top of latch 16 so as to depress latch 16 and thereby release connector 5 from its corresponding mating connector, as intended by the design. This situation is often acute in applications that require a plurality of interconnection devices to be engaged to the same device in a closely spaced architecture, e.g., mounted side-by-side and/or in stacked formation.

The present invention solves this problem in the art by providing a boot 8 having an integrally formed latch release 10 that is adapted to slip over a rear portion of electrical connector 5 so as to provide an easily accessible means for engaging and depressing latch 16 of electrical connector 5. More particularly, boot 8 comprises a one-piece molded slip-over cover for the rear portion of electrical connector 5 that includes a housing receptacle 30, a cable strain relief 32, and a release cowl 34. Boot 8 is typically formed from any of the well-known resilient but substantially stiff elastomeric polymer materials that are well known in the art. Such materials will exhibit good structural rigidity and an elastic resiliency that is sufficient to maintain the memory of its shape even after substantial deformation. Housing receptacle 30 comprises side walls 38, a top wall 40, and a bottom wall 42 that together define an internal recess 44 shaped so as to be complementary with the outer profile of housing 11 of electrical connector 5. A housing retention shoulder 48 is formed on an interior surface of bottom wall 42, with a corresponding mating recess formed in a portion of electrical connector 5. In this way, a secure engagement between boot 8 and electrical connector 5 may be maintained.

Cable strain relief 32 extends from the rear portion of housing receptacle 30, and comprises an inner passageway 50 that is sized and shaped so as to be complementary with the outer profile of cable 7. A wall 52 encloses passageway 50, and may includes a plurality of recesses 54 throughout its length. Recesses 54 provide for side-to-side bending of cable 7 when cable 7 is positioned within passageway 50, without placing high bending loads on either housing 11 of electrical connector 5 or the portion of housing 11 that structurally supports cable 7.

Release cowl 34 projects from an outer surface of housing receptacle 30, and includes side walls 60,61 and a radiused outer wall 63 that forms a portion of a latch engagement beam 66. More particularly, side walls 60,61 project outwardly from top wall 40 in spaced relation to one another, and together with radiused outer wall 63, define an interior cavity 69 of release cowl 34 that is in open communication with the interior 44 of housing receptacle 30. A pair of slots 68,70 are formed in side walls 60,61 respectively, and are positioned in aligned, spaced relation to one another. Each slot 68,70 defines a profile that tapers or narrows inwardly to a radiused corner 72. As a result of this construction, side walls 60,61 are partially divided by slots 68,70, and latch engagement beam 66 is substantially cantilevered by a living hinge portion (shown generally at reference numeral 79 in FIG. 5) that is formed through the portion of outer radiused wall 63 and side walls 60,61 that are adjacent to radiused corner 72. It will be understood that the choice of elastomeric material to form boot 8 must be such that it will exhibit good structural rigidity prior to deformation of latch engagement beam 66, and an elastic resiliency that is sufficient to maintain the memory of the shape of release cowl 34 even after substantial deformation.

Figure 5:
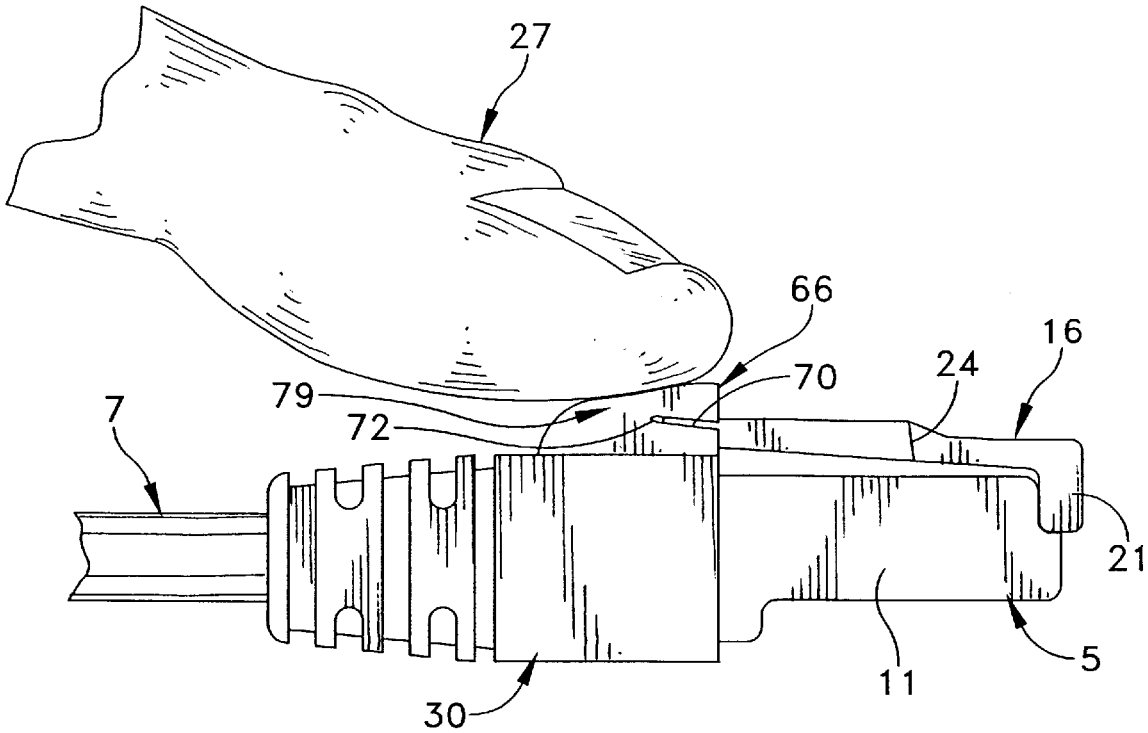
FIG. 5 is a perspective view of the connector boot having an integral latch assembled to an electrical connector including a terminated cable as shown in FIG. 1, but with a finger actuating the latch release.

As a result of this arrangement, when boot 8 is assembled to electrical connector 5, a portion of terminal end 26 of latch 16 extends into the interior cavity of release cowl 34, below latch engagement beam 66. When the outer surface of latch engagement beam 66 is depressed, e.g., by sliding a finger 27 over-top of it and the outer surface of boot 30, latch engagement beam 66 bends about its living hinge portion 79, thereby moving latch engagement beam 66 downwardly into contact with terminal end 26 of latch 16 (FIG. 5). As this occurs, latch 16 bends toward housing 11 of electrical connector 5 with elastic energy being stored in living hinges 21 and 79. This action, in turn, tends to bias latch 16 outwardly, away from electrical connector 5. With latch 16 disposed in this biased state, electrical connector 5 may be pulled from engagement with its mating connector (not shown). Thus the present invention allows for the easy actuation of latch 16 when electrical connector 5 is mated in a high density interconnection architecture, e.g., when mounted either side-by-side, in stacked formation, and/or in any combination with minimal clearance between adjacent connectors or other structures. When finger 27 is lifted from the outer surface of latch engagement beam 66, it resiliently springs back to its original shape and configuration.

It is to be understood that the present invention is by no means limited only to the particular constructions herein disclosed and shown in the drawings, but also comprises any modifications or equivalents within the scope of the claims.

What is claimed is:

1. A connector boot including an integral latch release for engaging an operative portion of a latching mechanism of a connector so as to switch said latching mechanism between a latched position and an unlatched position, comprising:

a housing having exterior walls that define an internal cavity sized to accept a portion of said connector and including a latch release cowl formed on one of said exterior walls, said release cowl comprising side walls and an outer wall that joins said side walls to form said cowl wherein slots are formed in said side walls so as to form a cantilevered beam in a portion of said outer wall wherein when said portion of said connector is positioned within said internal cavity of said boot, said cantilevered beam is in operative position over said latching mechanism of said connector.

2. A connector boot according to claim 1 wherein said cowl projects from an outer surface of said housing and said side walls and said outer wall define an interior cavity that is in open communication with the interior of said housing receptacle.

3. A connector boot according to claim 2 wherein said outer wall is radiused and said slots are formed in said side walls in aligned, spaced relation to one another and each slot including a profile that tapers inwardly to a radiused corner.

4. A connector boot including an integral latch release for engaging an operative portion of a latching mechanism of a connector so as to switch said latching mechanism between a latched position and an unlatched position, comprising:

a housing having exterior walls that define an internal cavity sized to accept a portion of said connector and including a latch release cowl formed on one of said exterior walls, said release cowl comprising side walls and a radiused outer wall that joins said side walls to form said cowl wherein tapered slots are formed in each of said side walls so as to form a cantilevered beam that is joined to said cowl by a living hinge in a portion of said outer wall wherein when said portion of said connector is positioned within said internal cavity of said boot, said cantilevered beam is in operative position over said latching mechanism of said connector.

5. A connector boot according to claim 4 wherein said cowl projects from an outer surface of said housing and said side walls and said outer wall define an interior cavity that is in open communication with the interior of said housing receptacle.

6. A connector boot according to claim 5 wherein said slots are formed in said side walls in aligned, spaced relation to one another and each slot includes a profile that tapers inwardly to a radiused corner.

* * * * *